United States Patent [19]

Dunkin

[11] Patent Number: 4,672,777

[45] Date of Patent: Jun. 16, 1987

[54] KNIFE SHARPENING DEVICE

[76] Inventor: Albert Dunkin, 15 Ellsworth St., Bridgeport, Conn. 06605

[21] Appl. No.: 836,847

[22] Filed: Mar. 6, 1986

[51] Int. Cl.[4] ..... B24B 3/54

[52] U.S. Cl. ..... 51/128; 51/116; 51/354; 76/82; 76/87; 76/88

[58] Field of Search ..... 51/128, 116, 354, 210, 51/208, 214, 285, 111, 113, 114; 76/82, 87, 86, 83, 82.2, 88

[56] References Cited

U.S. PATENT DOCUMENTS

| | | | |
|---|---|---|---|
| 1,027,005 | 5/1912 | Seymour | 51/116 |
| 1,177,821 | 4/1916 | Serafimidis | 51/208 |
| 2,077,689 | 4/1937 | Grobstein | 51/285 |
| 2,362,699 | 11/1944 | Kilian | 51/208 |
| 2,387,877 | 10/1945 | Broberg | 51/116 |
| 3,381,417 | 5/1968 | Eckstein | 51/128 |

*Primary Examiner*—Frederick R. Schmidt
*Assistant Examiner*—Robert A. Rose
*Attorney, Agent, or Firm*—Kramer and Brufsky

[57] ABSTRACT

A knife sharpening device having a base removably supporting a pair of grinding wheels at an acute angle to the horizontal. A housing encloses the base and includes a slot for receiving a knife edge, which when inserted in the housing will seat between the wheels. The wheels are biased into clamping engagement with the knife edge so that to and fro movement in the slot will cause the wheels to contact and grind the edge of the knife.

11 Claims, 6 Drawing Figures

KNIFE SHARPENING DEVICE

BACKGROUND AND SUMMARY OF THE INVENTION

This invention relates to a grinding apparatus, and more particularly, a kitchen-type appliance for grinding a knife edge to sharpen the same.

Knife sharpening devices have been known and used heretofore. Such devices are usually manufactured with non-replaceable parts. Accordingly, should the grinding or sharpening elements become worn, and they will after extended use, the device will no longer perform its function and must be thrown away and replaced. The knife sharpening device of the present invention provides another option.

In accordance with the construction of the present invention, a pair of grinding wheels are provided beneath a slot in the device housing which receives the edge of a knife to be sharpened. Each grinding wheel is connected to a shaft or spindle housed within a tube. A coil spring bears against the end of the shaft or spindle of the grinding wheel and biases it forwardly towards the other grinding wheel which is similarly supported at an inclined angle to the horizontal beneath the knife receiving slot. As the knife passes through the slot, it will contact each of the inclined faces of the side-by-side grinding wheels, causing each wheel to move rearwardly against the bias of the coil spring in its tube. When the knife edge is appropriately seated between the wheels, whose circumferences are designed to overlap slightly when extended, the knife edge will be firmly clamped between each of the grinding wheels. Backward and forward motion through the transversely slot across the axis of each grinding wheel spindle will cause the grinding wheels to rotate at an angle against the lower edge of the knife to grind and sharpen the same.

A roller can be located on opposite sides of the grinding wheels for providing a friction-free surface upon which the knife edge being sharpened can be readily slid in the slot relative to the grinding wheels.

The grinding wheel shafts or spindles are housed within a tube which is replaceably supported on the inclined surface of a support block encased within a substantially rectangular parallelopiped housing. The housing is threadably fastened to the support block and includes downwardly extending portions which contact each of the spindle receiving tubes to firmly lock the tube in place on the support block. Upon disassembly of the housing and support block, by removal of the threaded fasteners, each of the spindle receiving tubes can be removed from the support block along with each grinding wheel. The grinding wheels can then be removed from their support tubes and replaced and the entire assembly then reconnected, with the replacement parts readily intact.

BRIEF DESCRIPTION OF THE DRAWINGS

Further objects and advantages of the present invention will become apparent from the following description and claims, and from the accompanying drawings, wherein:

DETAILED DESCRIPTION OF THE PREFERRED EMBODIMENT

Figure 1:
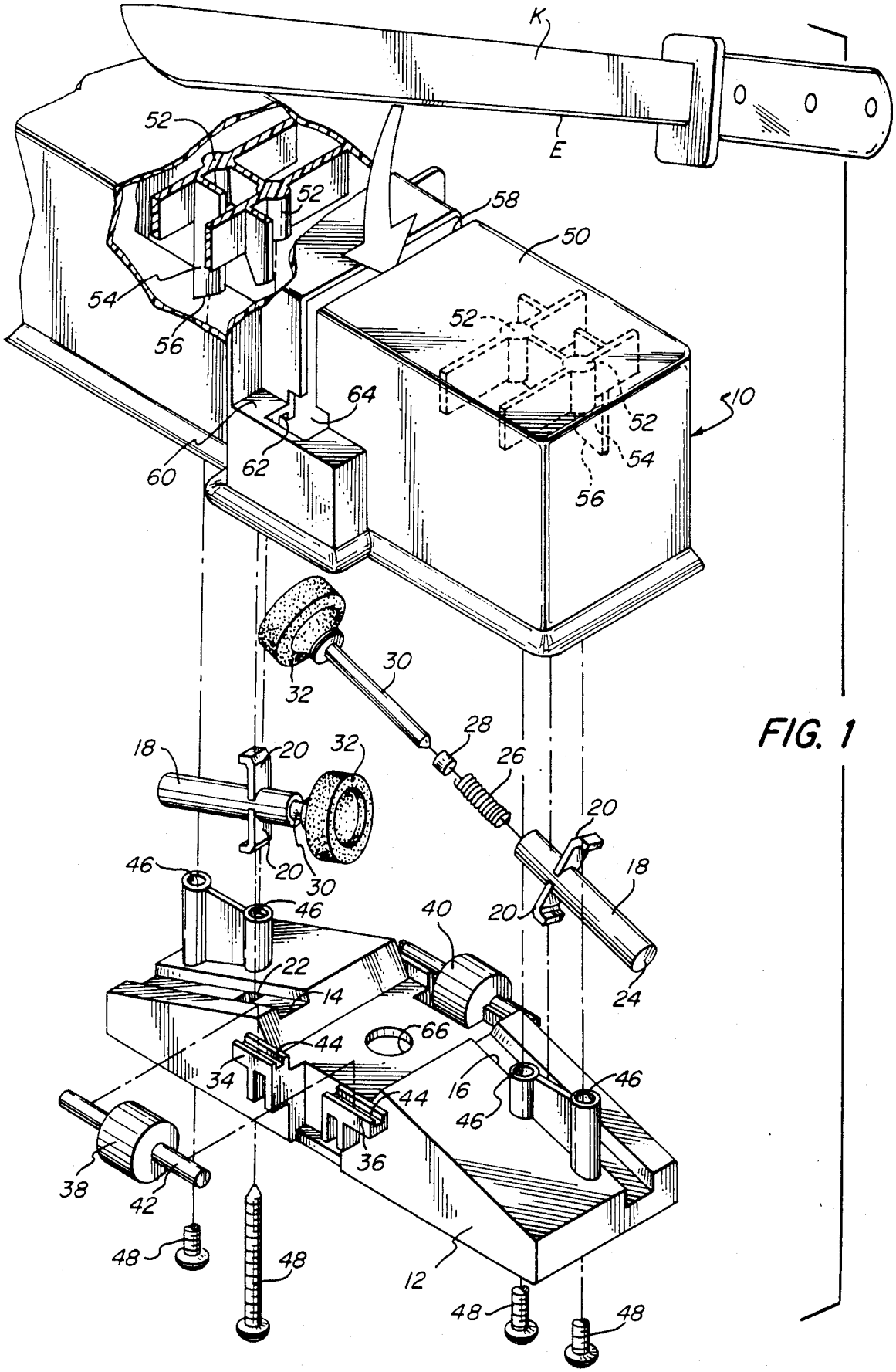
FIG. 1 is an exploded perspective view of the knife sharpening device of the present invention further illustrating how a knife is brought into contact with the grinding or sharpening elements thereof.
Figure 2:
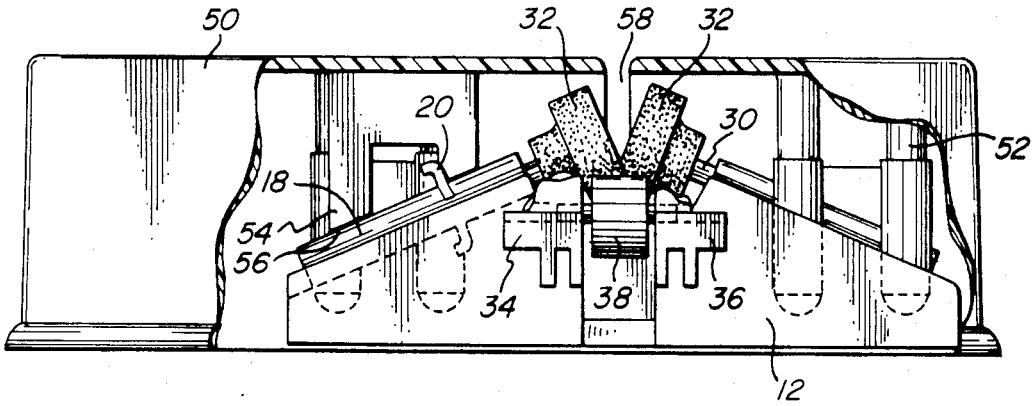
FIG. 2 is a side view in elevation of the knife sharpening device of FIG. 1 with portions removed to illustrate the components thereof.
Figure 3:
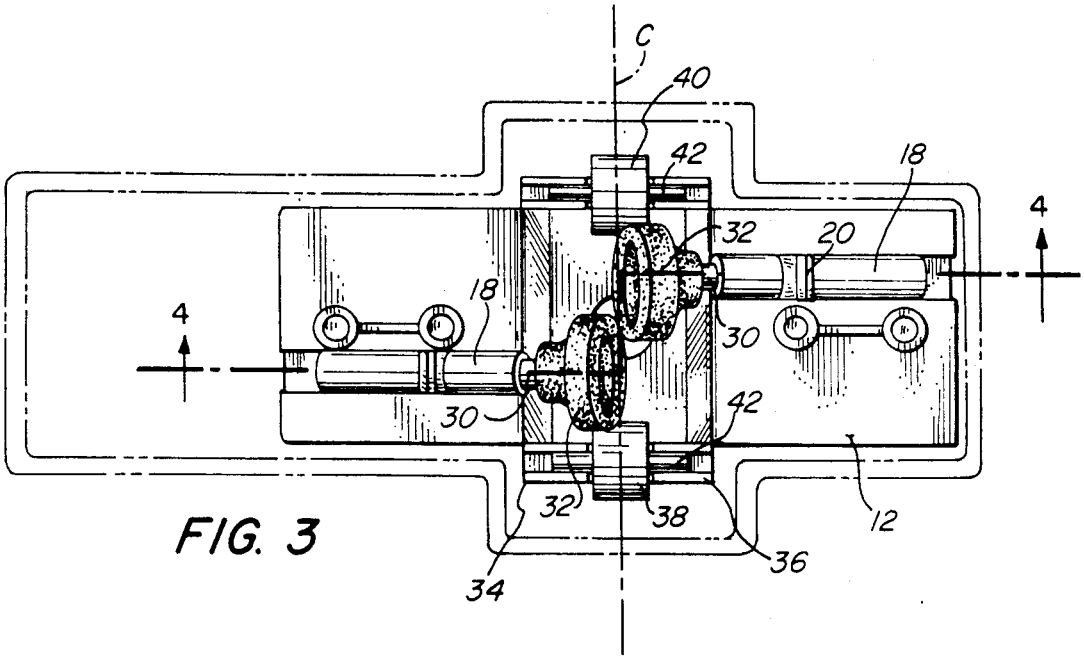
FIG. 3 is a top plan view of the support block and grinding wheel elements for sharpening a knife edge seated thereon with the outer housing or case illustrated in phantom lines.

Referring now to the drawings in detail, wherein like numerals indicate like elements throughout the several views, the knife sharpening device of the present invention is illustrated in FIG. 1 by the numeral 10.

The knife sharpening device 10 includes a grinding element support base 12 formed from plastic material and provided with a pair of grooves 14 and 16. Each of the grooves 14, 16 are offset laterally with respect to the longitudinal axis of the support base 12 and receives therein a grinding wheel spindle or shaft support tube 18. Each of the grooves 14, 16 are disposed at approximately a $22\frac{1}{2}°$ angle to the horizontal plane of the lower edges of support base 12. Each of the tubes 18 includes an L-shaped wing-like member 20 extending above and below the longitudinal axis of each of the tubes 18. One of the L-shaped wing-like members 20 can be received in and through an aperture 22 to loosely mount one of the tubes 18 within its respective groove 14, 16. Each of the tubes 18 can be readily removed from aperture 22 by simply canting or tilting the tube 18 about its longitudinal axis in order to manipulate the shorter leg of the L-shaped wing-like member 20 out of the slot 22. Similarly, the tube can be mounted in the groove 14, 16 by manipulating the shorter leg of one of the L-shaped wing-like members 20 so that it passes through the aperture and beneath the hollow support base 12 as illustrated more clearly in FIG. 4.

Each of the tubes 18, which are closed at a distal end 24, includes a coil spring 26, a spacer element 28 which has a smaller diameter than tube 18, and a spindle or shank 30 connected at its near end to a grinding wheel 32. Grinding wheel 32 can be made from an abrasive material such as aluminum oxide. Each of the springs 26 in each tube 18 biases spacer 28 into contact with shank 30 to push the shank 30 and its associated grinding wheel 32 outwardly towards the other grinding wheel. As shown more clearly in FIGS. 2, 4, 5 and 6, the grinding wheels 30 normally occupy an inclined position where their circumferences overlap a center line C therebetween.

Also received on support base 12 between a pair of support brackets 34, 36 provided on opposite sides of support base 12, are a pair of rollers 38, 40. Each of the rollers 38, 40 has a shaft 42 rotatably mounted in a slot 44 in each of the brackets 34, 36 for rotation therein.

A pair of upright flutes 46 are provided on both sides of the centerline C of support base 12 which receive threaded fasteners 48 to connect base 12 to a substantially rectangular parallelopiped case or housing 50. Threaded fasteners 48 are received in integral nut elements 52 extending downwardly from the interior of the top portion of case 50. Also extending downwardly from the top portion of case 50 are clamp members 54, each having a lower beveled edge 56 adapted to contact one of the tubes 18 to clamp the tube 18 firmly in its respective groove 14, 16 when the support base 12 is threadably fastened to case 50.

Figure 4:
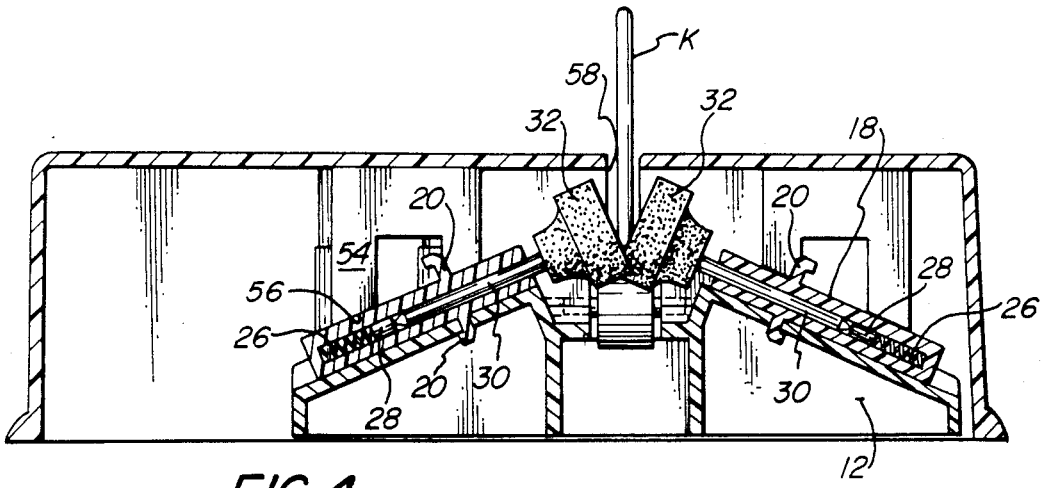
FIG. 4 is a cross-sectional view taken substantially on the plane indicated by line 4—4 of FIG. 3.
Figure 5:
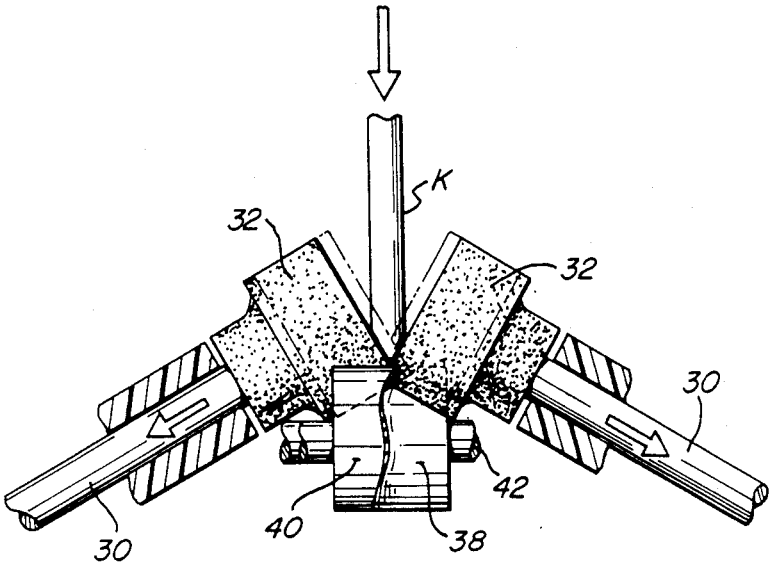
FIG. 5 is an enlarged view of the central portion of FIG. 4 illustrating the manner in which the knife edge to be sharpened interacts with the grinding rollers of the present invention to sharpen the knife edge.
Figure 6:
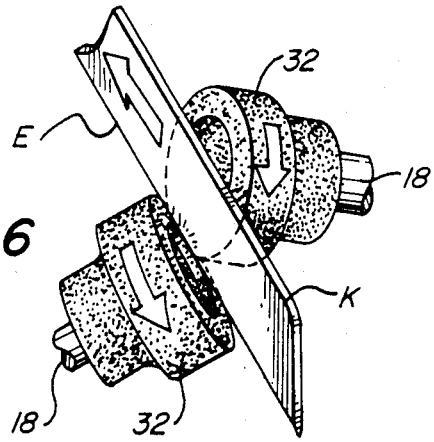
FIG. 6 is a perspective view of the elements illustrated in FIG. 5.

Case 50 is also provided with an elongated slot 58 opening along three sides of the case and coinciding with the centerline C of support base 12 which extends between grinding rollers 32. As shown in FIGS. 4, 5 and 6, a knife K having an elongated cutting edge E to be sharpened, can be inserted in slot 58 and moved downwardly until it contacts the surface of each of the rollers 38, 40. As it is moved downwardly into contact with the rollers 38, 40, it contacts the outer grinding surfaces of each wheel 32 and pushes each wheel away from each other and centerline C against the bias of springs 26 in each tube 18. When the knife comes to rest on each of the rollers 38, 40, the grinding rollers 32 will thus be moved away from each other so as to exert a clamping action on the knife blade. As shown in FIG. 6, the blade of knife K can be then moved backwards and forwards along rollers 38, 40 in slot 58 causing concommitant rotation of each of the rollers 32 which will grind the knife edge E as they rotate. Since the rollers 32 are disposed at an angle with respect to knife edge E, the edge E will be readily ground through the removal of material along edge E. Material removed from the edge can fall through a hole 66 in base 12 or water flowing through slots 58 to wash the parts may exit through hole 66.

The rollers 38, 40 should be supported at an appropriate elevation with respect to the grinding rollers 32 so that when the knife edge E strikes and is seated on each of the rollers 38, 40, there is sufficient clamping pressure exerted by the rollers on the knife edge to effect grinding of the same. Further, if the rollers are mounted too low relative to the grinding wheels, the grinding action of the rollers will take place not at an angle but in a plane approaching that which is parallel to the knife edge E so that a minimal amount of grinding takes place. Ideally, when a knife blade B is inserted in slot 58 and seated on rollers 38, 40 between grinding wheels 32, the edge E should contact the circumference of each wheel at a point on the circumference at angle of about 30° to 60° to the centerline C of base 12 passing through the center of each wheel 32.

Should the grinding wheels 32 become worn, they can be readily replaced by simply unthreading fasteners 48 to separate the support base 12 from case 50 and then removing each tube 18 and replacing roller 32 and its shank 30 within the tube. The same is true upon wear of each of the rollers 38, 40 which merely have to be lifted upwardly from its support slots 44 in brackets 34, 36. The outer surface of case 50 is provided with complementary brackets 60 having downwardly facing slots 62. The brackets 60 align and cover each slot 44 near bracket 34, 36 to clamp the roller shafts 42 between the upwardly facing slots 44 and downwardly facing slots 62 to preclude their removal while permitting rotation thereof. Each of the rollers 38, 40 will extend upwardly through an opening or cut out portion 64 provided within the case at the end of the side portions of slot 58 extending into the top of bracket 60.

In order to promote even wear of the grinding wheels 32, each wheel is provided with a concentric recess spaced from its circumference. This will substantially preclude high points from forming on the narrow circumference, which may result in marring the blade B by grinding or pitting the blade when it contacts the high point.

During use, the case 50 can be grasped with one hand while the knife K is held in the other and inserted within slot 58. Then, the knife edge E is moved backward and forward against the grinding surfaces of rollers 32 on rollers 38, 40 while the case 50 is held with the opposite hand to effect sharpening of edge E.

What is claimed is new is:

1. Knife sharpening apparatus comprising:

a base having a longitudinal axis and having a pair of grooves on its top surface each on opposite sides of the longitudinal axis of said base, each groove being disposed on said surface at an acute angle to the horizontal, a first and second means on said base each supporting a grinding wheel at an acute angle to the horizontal on opposite sides of the longitudinal axis of said base, each means including an elongated tube having an open end and a closed distal end, a shaft connected to said grinding wheel received in said open end of said elongated tube, and a coil spring between the end of said shaft and said closed distal end of said tube for biasing said shaft away from said closed distal end of said elongated tube, roller means mounted on opposite sides of said base on opposite sides of the longitudinal axis thereof whose mid-portion is substantially coincident with a centerline through said base substantially perpendicular to the longitudinal axis thereof, First and second grinding wheels mounted respectively in said first and second support means having an abrasive surface extending toward each other and having a portion of the circumference thereof extending beyond the center-line of said base, means for removably connecting each of said elongated tubes to said base in seated arrangement in said grooves.

2. The apparatus of claim 1, including:

a housing removably connected to said base, said housing including an elongated slot for receiving the blade of a knife, said elongated slot opening in a plane coincident with the centerline of said base so that a knife inserted in said elongated slot can have an edge to be sharpened seated on said roller means between said first and second grinding wheels.

3. The apparatus of claim 1 wherein said removable connecting means includes a substantially L-shaped wing member on each support tube received through an aperture in said base in each of said slots.

4. The apparatus of claim 3 including a pair of spaced brackets mounted on opposite sides of said base, each bracket having a upwardly opening slot for receiving a shaft of said roller means.

5. The apparatus of claim 3 wherein said housing includes means for clamping each support tube to said base upon connection of said housing to said base.

6. The apparatus of claim 5 wherein said clamping means includes a downwardly extending member on the interior of said housing having a beveled edge for contacting the exterior of said tube.

7. The apparatus of claim 4 wherein said housing includes a pair of spaced brackets on opposite sides of said housing, each of said brackets having a pair of spaced down-wardly opening slots adapted to overlie one of the upwardly opening slots in said base brackets to clamp a shafat of said roller means therebetween.

8. The apparatus of claim 5 wherein said housing is removably connected to said base by threaded fasteners received through flutes extending between said base and housing, each fastener being secured to a nut on the interior top surface of said housing.

9. The apparatus of claim 1 wherein the abrasive surface on each of said grinding wheels has a concentric recess spaced from the outer circumference thereof.

10. Knife sharpening apparatus comprising:

a base having a longitudinal axis and having a pair of grooves on its top surface each on opposite sides of the longitudinal axis of said base, each groove being disposed on said surface at an acute angle to the horizontal, a first and second means on said base each supporting a grinding wheel at an acute angle to the horizontal on opposite sides of the longitudinal axis of said base, each means including an elongated tube having an open end and a closed distal end, a shaft connected to said grinding wheel received in said open end of said elongated tube, and a coil spring between the end of said shaft and said closed distal end of said tube for biasing said shaft away from said closed distal end of said elongated tube, roller means mounted on opposite sides of said base on opposite sides of the longitudinal axis thereof whose mid-portion is substantially coincident with a centerline through said base substantially perpendicular to the longitudinal axis thereof, first and second grinding wheels mounted respectively in said first and second support means having an abrasive surface extending toward each other and having a portion of the circumference thereof extending beyond the centerline of said base, a spacer element inserted into said elongated tube between said coil spring and said shaft connected to said grinding wheel such that said coil biases said spacer into contact with said shaft.

11. Knife sharpening apparatus comprising:

a base having a longitudinal axis and having a pair of grooves on its top surface each on opposite sides of the longitudinal axis of said base, each groove being disposed on said surface at an acute angle to the horizontal, a first and second means on said base each supporting a grinding wheel at an acute angle to the horizontal on opposite sides of the longitudinal axis of said base, each means including roller means mounted on opposite sides of said base relative said grinding wheel so that when a knife blade is seated on said roller means between said grinding wheels, it will contact said grinding wheels at a point on the circumference thereof at an angle approximately 30° to 60° of the centerline of said base passing through the center of each wheel, first and second grinding wheels mounted respectively in said first and second support means having an abrasive surface extending toward each other and having a portion of the circumference thereof extending beyond the centerline of said base, and means associated with said first and second support means for biasing each grinding wheel toward the other grinding wheel.

* * * * *